US008813267B2

(12) United States Patent
Maier

(10) Patent No.: US 8,813,267 B2
(45) Date of Patent: Aug. 26, 2014

(54) SPORTS GARMENT FOR CYCLING

(75) Inventor: Roger Maier, Carona (CH)

(73) Assignee: Assos of Switzerland S.A., San Pietro di Stabio (CH)

( * ) Notice: Subject to any disclaimer, the term of this patent is extended or adjusted under 35 U.S.C. 154(b) by 23 days.

(21) Appl. No.: 13/406,161

(22) Filed: Feb. 27, 2012

(65) Prior Publication Data

US 2012/0266361 A1 Oct. 25, 2012

(30) Foreign Application Priority Data

Apr. 20, 2011 (EP) ..... 11163254

(51) Int. Cl.

| | |
|---|---|
| ***A41B 9/02*** | (2006.01) |
| ***A41D 13/05*** | (2006.01) |
| ***A41D 1/08*** | (2006.01) |
| *A41D 13/00* | (2006.01) |
| *A41D 27/00* | (2006.01) |

(52) U.S. Cl.

CPC ..... *A41D 1/084* (2013.01); *A41B 9/023* (2013.01)

USPC ..... 2/403; 2/405; 2/408; 2/214; 2/78.2

(58) Field of Classification Search

USPC ..... 2/410, 6.6, 6.8, 411–414, 403, 405, 2/228, 69, 408, 214, 78.2

See application file for complete search history.

(56) References Cited

U.S. PATENT DOCUMENTS

| | | | | |
|---|---|---|---|---|
| 6,393,618 | B2 * | 5/2002 | Garneau | 2/228 |
| 6,990,693 | B2 * | 1/2006 | Reschewitz | 2/228 |
| 8,042,197 | B2 * | 10/2011 | Maier | 2/228 |
| 8,087,095 | B2 * | 1/2012 | Maier | 2/102 |
| 8,087,097 | B2 * | 1/2012 | Maier | 2/227 |
| 8,230,520 | B2 * | 7/2012 | Riondato | 2/79 |
| 2004/0143890 | A1 | 7/2004 | Reschewitz | |
| 2005/0066423 | A1 * | 3/2005 | Hogan | 2/227 |
| 2006/0191052 | A1 * | 8/2006 | Bulian | 2/23 |
| 2007/0186328 | A1 * | 8/2007 | Bulian | 2/69 |
| 2007/0226869 | A1 * | 10/2007 | Maier | 2/69 |
| 2008/0047046 | A1 * | 2/2008 | Maier | 2/102 |
| 2008/0229486 | A1 * | 9/2008 | Maier | 2/401 |
| 2009/0113598 | A1 * | 5/2009 | Maier | 2/79 |
| 2009/0158491 | A1 * | 6/2009 | Maier | 2/78.1 |
| 2012/0222191 | A1 * | 9/2012 | Maier | 2/79 |

FOREIGN PATENT DOCUMENTS

| | | |
|---|---|---|
| DE | 202008016342 | 3/2009 |
| GB | 2466505 | 6/2010 |
| WO | WO 2008085113 | 7/2008 |

OTHER PUBLICATIONS

"Sleeve." Merriam-Webster.com. Merriam-Webster, n.d. Web. Nov. 19, 2013. <http://www.merriam-webster.com/dictionary/sleeve>.*

* cited by examiner

*Primary Examiner* — Bobby Muromoto, Jr.

(74) *Attorney, Agent, or Firm* — Novak Druce Connolly Bove + Quigg LLP

(57) ABSTRACT

A sports garment (10) for cycling includes a sleeve-shaped part (20) in the inner side of the crotch area, facing the body of the user when the garment is worn, the sleeve-shaped member being arranged to provide room (27) for accommodation of the male genitals and in particular the penis of the user.

8 Claims, 2 Drawing Sheets

SPORTS GARMENT FOR CYCLING

CROSS-REFERENCE TO RELATED APPLICATIONS

This Application claims priority to European Patent Application No. 11163254, filed Apr. 20, 2011, entitled "A SPORTS GARMENT FOR CYCLING," the entire contents of which are incorporated herein by reference.

FIELD OF THE INVENTION

The invention relates a sports garment, in particular for cycling. The invention relates in particular to a sports garment such as cycling trousers.

PRIOR ART

Cycling trousers are usually equipped with a seat pad made of a soft material for protection of perineal and/or ischiatic parts of the body, which are in contact with the saddle of the bicycle and may cause discomfort or pain during intensive use. Said seat pad usually comprise a plurality of layers of soft materials, capable of damping bumps and fatigue stresses, and fabric layers in contact with the skin.

EP-A-1269873 discloses trousers for cyclists with a seat pad in the form of an insert which is composed of a base layer of expanded material and an elastic fabric in contact with the body of the user.

A particular care is dedicated to protect the genitals of the user. EP-A-1972216 discloses a cycling suit with anatomically shaped seat pad to shield and support the male genitals, in particular the scrotal area.

There is a continuous effort to improve the performance and comfort of the seat pad, especially for intensive use. In particular, adaptation and close fit to the body as well as proper support of the crotch area and genitals are some of the most important requirements of a cycling suit.

SUMMARY OF THE INVENTION

The applicant has realized that the need to use an underwear introduces a limitation to the performance of a cycling outfit. In fact, a common underwear has inferior performance of skin-tightness, adherence and ability to follow the movement of the body, compared to a specific cycling garment. Underwear may have for example seams that cause a discomfort to the user under intensive use. More in general, the use of two piece of garment, namely the underwear and the cycling outfit, has been recognized as less efficient in terms of adaptation to the body. Since a cycling garment must perform like a second skin, this disadvantage is not negligible. On the other hand, cycling without any underwear is unfit because of lack of accommodation for the genitals and for this reason the use of underwear has been deemed essential so far, especially for a male user, despite the related drawbacks. This problem has not been solved or even recognized in the prior art.

The invention proposes an accommodation and containment member for male genitals, in particular for the penis of the user, which is incorporated in the cycling garment. The above problem is solved with a sports garment for cycling comprising a padding in a crotch area and characterized by comprising a sleeve member in the inner side of the crotch area, facing the body of the user when the garment is worn, and arranged to accommodate the male genitals and in particular the penis of the user during the use.

Preferably said sleeve member is made with an open front section and an open end section, thus forming a passing-through accommodation for the penis of the user during the use.

The garment may comprise a seat pad to provide said padding in the crotch area. In this case the sleeve member can be associated to the seat pad of the garment according to some embodiments of the invention. According to other embodiments, the function of the seat pad is performed by soft protection pads associated to or incorporated into selected portions of the garment. In an exemplificative pad-less embodiment the garment comprises a plurality of fabric portions reciprocally associated, perimetrically and at a crotch median line, where two of said fabric portions are reciprocally associated at said crotch median line and comprise at least one shaped protection pad each, so that at least two shaped protection pads are positioned at the saddle area of the garment symmetrically as to said crotch median line, the assembly of said two fabric portions acting as a seat pad. An example of a padless garment is further disclosed in patent EP 1 834 532 of the same applicant.

According to a preferred embodiment, the sleeve member for accommodation of the penis is associated with a central loose part of a seat pad. More in detail, the garment has a seat pad in the crotch area and said seat pad comprises a front attachment region to the garment, a rear attachment region to the garment and a central portion free from attachments to the garment. Said central portion constitutes a loose bridge portion of the seat pad in the inner crotch area of the garment and the sleeve member for accommodation of the penis is associated to said central loose portion. An advantage of this embodiment is that the sleeve member is free to move in the inner crotch area of the garment and substantially unaffected by the pedaling action.

In a preferred embodiment said sleeve member is formed with a fabric patch attached to a seat pad of the garment or, in even more preferred embodiments, said sleeve member is attached to said loose portion of the seat pad. Preferably said fabric patch has side edges attached to said seat pad or to said loose portion of seat pad. More preferably said fabric patch has a shaped cut at least in correspondence of a front section facing the user's body. Said cut can be a substantially arc-shaped cut or a V-shaped cut or a U-shaped cut according to some embodiments.

The loose bridging portion of seat pad is delimited by ends of a front attachment region and of a rear attachment region, either realized as continuous attachment line or plurality of attachment points. Preferably, the distance between a left or right end of the front attachment region and a corresponding left or right end of the rear attachment region is at least 5 cm to allow the loose-fitting effect of the bridging portion of the seat pad. Said distance is measured on the projection of the seat pad on a line parallel to a longitudinal median axis of the seat pad, as above. Any attachment technique which is per se known could be used to realize said attachment lines or points, for example stitching, gluing or other techniques such as thermal welding.

The front part and/or the rear part of the seat pad may have a concave shell shape. A concave shell shape is preferred for making the sports trousers more anatomical and wearable.

Details of the seat pad can be realized according to several techniques which are known per se. The seat pad is realized with a soft material and may comprise for example one or more soft sponge elements inserted in a fabric pocket.

A garment according to the invention is preferably an integral garment having a top part covering at least partly the torso of the user, and a lower part forming short or long trousers. Different embodiments of the invention include a garment for winter or summer use.

The garment of the invention can be used by a male user without underwear, thanks to the safe accommodation for genitals and in particular for the penis. The invention provides a stable accommodation of the penis which is substantially unaffected by alternate movement of pedaling even under an intensive use.

The preferred embodiment with a loose portion of the seat pad has the further advantage that the seat pad remains adherent to the garment in the crucial front/rear crotch regions where the body needs the maximum of padding effect while the central loose region provides enhanced comfort and ability to precisely follow the movements of the body. The seat pad can freely twist under the pedaling action while the central loose portion remains substantially free and hence the soft pad is able to offer better adaptation to the body and especially a better support for male genitals.

It should be noted that the term of sports garment as used in this description may encompass a garment consisting of shorts or long trousers, or a garment comprising a trousers portion, e.g. an integral body. More in detail, the term of cycling garment is directed to a wear item suitable for use in the sport of cycling, like for example shorts or long trousers, overalls, tights body suit and similar. The term seat pad is used to identify the shaped pad that is associated with the trousers or formed in the trousers themselves, to protect the perineal area of the body, which during the use is in contact with the bicycle saddle.

The advantages of the invention will be elucidated with the following detailed description of indicative and not limiting examples.

DETAILED DESCRIPTION

Figure 1:
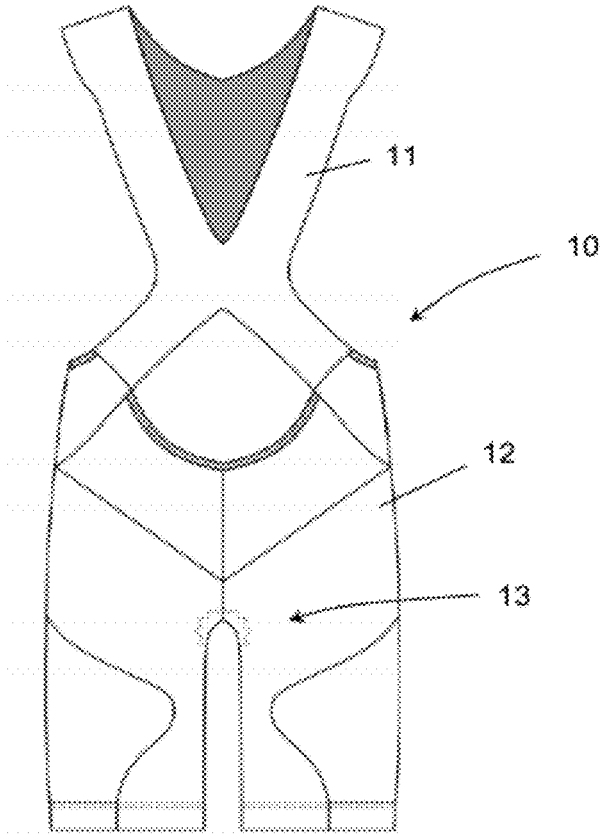
FIG. 1 is a front view of a garment according to one embodiment of the invention.

FIG. 1 is a view of a cycling garment 10 which, in this embodiment, has an upper part 11 with shoulder straps covering a part of the torso, and a lower part 12 acting as trousers. The garment 10 has a crotch area 13 which is padded for example with a seat pad attached to the inner side of the garment and comprising soft pads.

Figure 2:
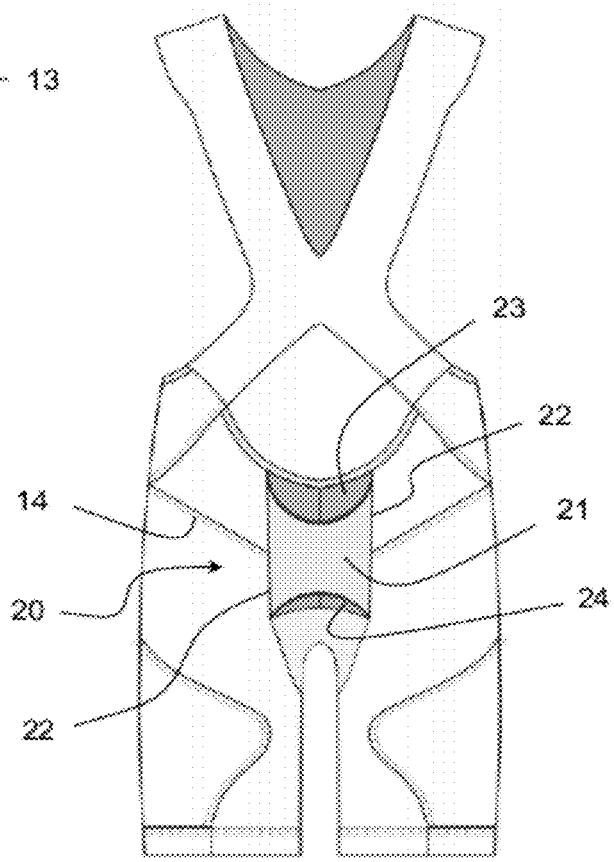
FIG. 2 is a reverse view of the garment of FIG. 1.

FIG. 2 is a view of the garment 10 reversed (inside out) showing internal seams 14. As seen in this figure, the garment 10 has a sleeve member 20 located in the inner side of the crotch area and facing the user's body when the garment 10 is worn. Said sleeve member 20 provides accommodation for the penis of the user when the garment 10 is worn.

Figure 3:
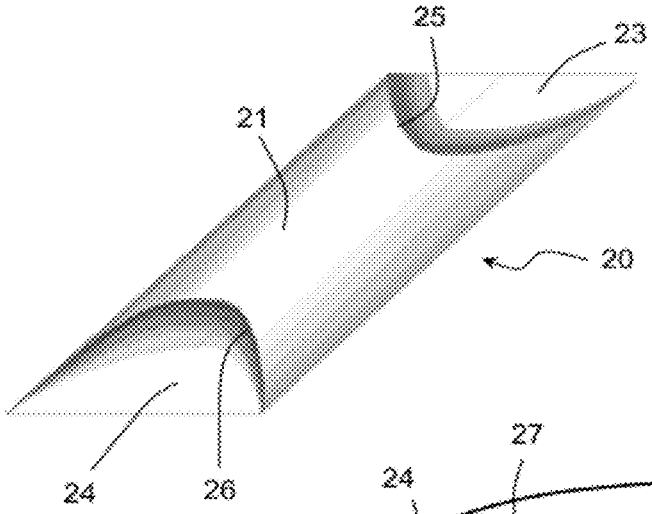
FIG. 3 is a detail of a particular of the garment of FIG. 1.

In the embodiment of the figures, said sleeve member 20 is realized with a fabric patch 21 which is attached for example to a seat pad of the garment along side edges 22. The sleeve member 20 has an open front section 23 for introduction of the penis, while the garment is worn without underwear, and an open end section 24. Preferably said fabric patch 21 has a front shaped cut 25 and a rear shaped cut 26 at the front section 23 and at the end section 24, as seen in the detail of FIG. 3. Said shaped cuts 25, 26 are preferably arc-shaped or V-shaped or U-shaped.

Figure 4:
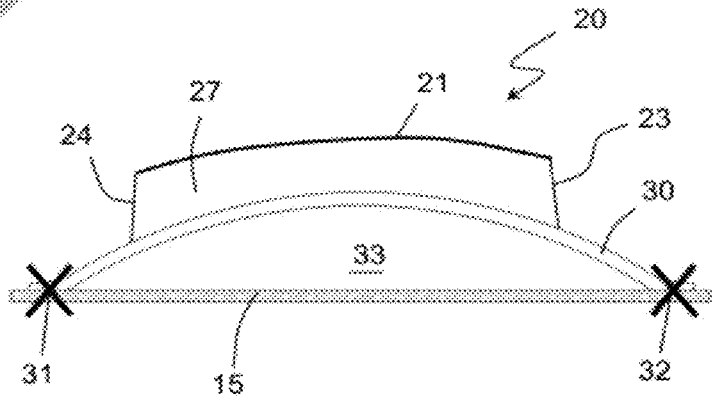
FIG. 4 is a sectional view of the seat pad of a garment according to a preferred embodiment of the invention.

A preferred embodiment is disclosed in the sectional view of FIG. 4. Numeral 15 denotes a fabric portion of the garment 10, located in the crotch area; a seat pad generally denoted with 30 is associated to the garment 10 and the sleeve member 20 for accommodation of the penis is in turn associated to said seat pad 30. More in detail, in a preferred embodiment the seat pad 30 is attached to the portion 15 of garment 10 by means of attachments 31, 32 which may be made of continuous attachment lines (e.g. seam lines) or several attachment points. A central portion of the seat pad 30 is free from attachments to the garment 10, so that said central portion remain loose and leaves an air gap 33. The side edges 22 of the patch 21 are attached to said seat pad 30 in the central loose portion of the same. FIG. 4 shows that the member 20 defines a passing-through channel 27 between the seat pad 30 and the patch 21, which channel 27 provides room for accommodating the penis of the user when the garment is worn.

It should be noted that any references to attachments may include any known technique including stitching, gluing, thermal welding, etc.

Figure 5:
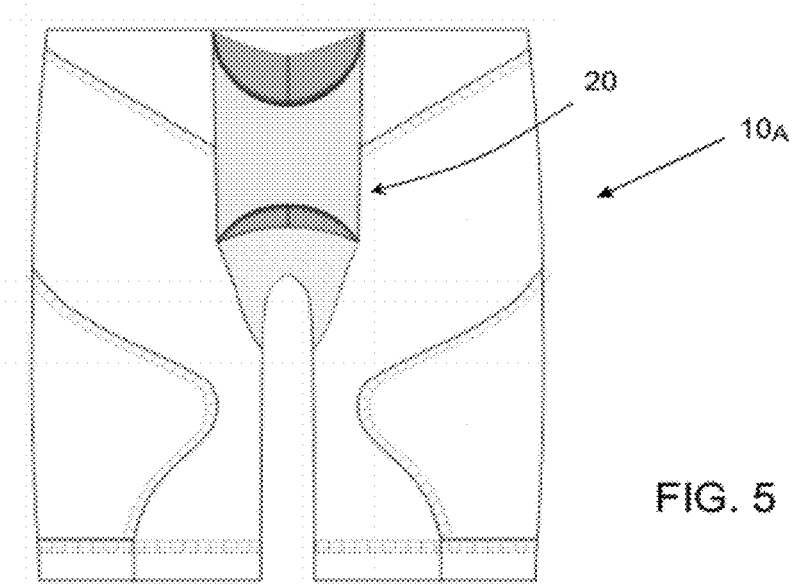
FIG. 5 is a front view of another garment according to the invention.

FIG. 5 shows another embodiment of a garment $\mathbf{10}_A$ formed as a pair of cycling trousers and comprising the sleeve member 20 as above described.

The use is the following: the garment 10 or $\mathbf{10}_A$ is worn by a male user with no underwear introducing the penis in the channel 27 formed by the sleeve member 20 (FIG. 4). Then, the genitals and in particular the penis are contained and held in a stable position during intensive use.

The invention claimed is:

1. A sports garment (10, 10A) for cycling, the garment comprising a padding in a crotch area (13) and characterized by a sleeve member (20) in the inner side of the crotch area, facing the body of the user when the garment is worn, said sleeve member having an open front section (23) and an open end section (24), thus forming a passing-through accommodation for the penis of the user during the use.

2. The garment according to claim 1, said sleeve member being associated to a seat pad (30) of the garment.

3. The garment according to claim 1, said seat pad (30) comprising a front attachment region (31) to the garment; a rear attachment region-(32) to the garment; a central portion free from attachments to the garment, said central portion forming a loose bridge portion of the seat pad in the inner crotch area of the garment, said sleeve member (20) being associated to said central loose portion, wherein the sleeve member (20) is free to move in the inner side of the crotch area of the garment such that the sleeve member (20) is substantially unaffected by pedalling action.

4. The garment according to claim 2, said sleeve member being formed with a fabric patch (21) attached to said seat pad (30) or to said loose portion of the seat pad.

5. The garment according to claim 4, said fabric patch having a substantially arc-shaped or V-shaped or U-shaped cut (25, 26) at least at a front section facing the user's body for insertion of the penis while the garment is worn.

6. The garment according to claim 1, the garment being an integral garment (10) having a top part (11) covering at least partly the torso of the user, and a lower part (12) forming short or long trousers.

7. A sports garment (10, 10A) for cycling, the garment comprising a padding in a crotch area (13) and characterized by a sleeve member (20) in the inner side of the crotch area, facing the body of the user when the garment is worn, said sleeve member having an open front section (23) and an open end section (24), thus forming a passing-through accommodation for the penis of the user during the use, said sleeve member being associated to a seat pad (30) of the garment, said seat pad (30) comprising a front attachment region (31) to the garment; a rear attachment region-(32) to the garment; a central portion free from attachments to the garment, said central portion forming a loose bridge portion of the seat pad in the inner crotch area of the garment, said sleeve member (20) being associated to said central loose portion, wherein the sleeve member (20) is free to move in the inner side of the crotch area of the garment such that the sleeve member (20) is substantially unaffected by pedalling action, and wherein said sleeve member is formed with a fabric patch (21) attached to said seat pad (30) or to said loose portion of the seat pad, said fabric patch having a substantially arc-shaped or V-shaped or U-shaped cut (25, 26) at least at a front section facing the user's body for insertion of the penis while the garment is worn.

8. The garment according to claim 7, the garment being an integral garment (10) having a top part (11) covering at least partly the torso of the user, and a lower part (12) forming short or long trousers.

* * * * *